US005836379A

United States Patent [19]

Counterman

[11] Patent Number: 5,836,379

[45] Date of Patent: Nov. 17, 1998

[54] AIR PREHEATER HEAT TRANSFER SURFACE

[75] Inventor: Wayne S. Counterman, Wellsville, N.Y.

[73] Assignee: ABB Air Preheater, Inc., Wellsville, N.Y.

[21] Appl. No.: 755,484

[22] Filed: Nov. 22, 1996

[51] Int. Cl.[6] ..... F28D 7/02

[52] U.S. Cl. ..... 165/10; 165/8

[58] Field of Search ..... 165/10, 8, 6, 4

[56] References Cited

U.S. PATENT DOCUMENTS

| | | | |
|---|---|---|---|
| 1,915,742 | 6/1933 | Mautsch | 165/10 X |
| 2,438,851 | 3/1948 | Gates | 165/10 |
| 2,596,642 | 5/1952 | Boestad | 165/10 |
| 2,940,736 | 6/1960 | Ödman | 165/10 |
| 2,983,486 | 5/1961 | Rosenberg | 165/10 |
| 3,369,592 | 2/1968 | Dedow | 165/10 |
| 3,373,798 | 3/1968 | Brummett | 165/10 |
| 3,554,273 | 1/1971 | Kritzler | 165/10 |
| 4,061,183 | 12/1977 | Davis | 165/8 |
| 4,345,640 | 8/1982 | Cullinan | 165/10 |
| 4,396,058 | 8/1983 | Kurschner et al. | 165/8 |
| 4,449,573 | 5/1984 | Pettersson et al. | 165/10 |
| 4,553,458 | 11/1985 | Schoonover | 83/33 |
| 4,744,410 | 5/1988 | Groves | 165/10 |
| 4,930,569 | 6/1990 | Harder | 165/8 X |
| 4,953,629 | 9/1990 | Karlsson et al. | 165/10 |
| 5,318,102 | 6/1994 | Spokoyny et al. | 165/10 |

FOREIGN PATENT DOCUMENTS 668476 3/1952 United Kingdom .

*Primary Examiner*—John Rivell
*Assistant Examiner*—Christopher Atkinson
*Attorney, Agent, or Firm*—Alix, Yale & Ristas, LLP

[57] ABSTRACT

A heat transfer element for a rotary regenerative preheater has first and second heat transfer plates. The first heat transfer plate defines a plurality of generally equidistantly laterally spaced apart parallel straight notches. Each notch has adjacent double ridges extending transversely from opposite sides of the first heat transfer plate. Undulations extend between the notches. The second heat transfer plate is adjacent the first heat transfer plate and defines a plurality of generally equidistantly laterally spaced apart parallel straight flat sections. Undulations extend between the flat sections and the flat sections are spaced apart a distance generally equal to the lateral spacing of the notches. The notches of the first heat transfer plate are in contact with the flat sections of the second heat transfer plate to define channels therebetween.

9 Claims, 5 Drawing Sheets

PRIOR ART

AIR PREHEATER HEAT TRANSFER SURFACE

BACKGROUND OF THE INVENTION

The present invention relates to rotary regenerative air preheaters for the transfer of heat from a flue gas stream to a combustion air stream. More particularly, the present invention relates to a heat transfer surface of an air preheater.

Rotary regenerative air preheaters are commonly used to transfer heat from the flue gases exiting a furnace to the incoming combustion air. Conventional rotary regenerative air preheaters have a rotor rotatably mounted in a housing. The rotor supports heat transfer surfaces defined by heat transfer elements for the transfer of heat from the flue gases to the combustion air. The rotor has radial partitions or diaphragms defining compartments therebetween for supporting the heat transfer elements. Sector plates extend across the upper and lower faces of the rotor to divide the preheater into a gas sector and an air sector. A hot flue gas stream is directed through the gas sector of the preheater and transfers heat to the heat transfer elements on the continuously rotating rotor. The heat transfer elements are then rotated to the air sector of the preheater. The combustion air stream directed over the heat transfer elements is thereby heated. In other forms of regenerative preheaters, the heat transfer elements are stationary and the air and gas inlet and outlet hoods rotate.

Heat transfer elements for regenerative air preheaters have several requirements. Most importantly, the heat transfer element must provide the required quantity of heat transfer or energy recovery for a given depth of the heat transfer element. Conventional heat transfer elements for preheaters use combinations of flat or ribbed form-pressed or rolled-pressed steel sheets or plates. When in combination, the plates form flow passages for the movement of the flue gas stream and air stream through the rotor of the preheater. The surface design and arrangement of the heat transfer plates provides contact between adjacent plates to define and maintain the flow passages through the heat transfer element. Further requirements for the heat transfer elements are that the elements produce minimal pressure drop for a given depth of the heat transfer elements, and furthermore, fit within a small volume.

Heat transfer elements are subject to fouling from particulates and condensed contaminants, commonly referred to as soot, in the flue gas stream. Therefore, another important performance consideration is low susceptibility of the heat transfer elements to significant fouling, and furthermore easy cleaning of the heat transfer element when fouled. Fouling of the heat transfer elements is conventionally removed by soot blowing equipment emitting pressurized dry steam or air to remove by impact the particulates, scale and contaminants from the heat transfer elements. The heat transfer elements therefore must allow the soot blower energy to penetrate through the layers of heat transfer elements with sufficient energy to clean heat transfer elements positioned further from the soot blowing equipment. In addition, the heat transfer elements must also survive the wear and fatigue associated with soot blowing.

Another consideration for designing heat transfer elements is the ability to have a line of sight view through the depth of the heat transfer elements. The line of sight allows infrared or other hot spot detection systems to sense hot spots or early stages of fires on the heat transfer elements. Rapid and accurate detection of hot spots and early element fires minimizes damage to the preheater.

Conventional preheaters typically employ multiple layers of different types of heat transfer elements on the rotor. The rotor has a cold end layer positioned at the flue gas outlet, an intermediate layer and a hot end layer positioned at the flue gas inlet. Typically the hot end layer employs high heat transfer elements which are designed to provide the highest relative energy recovery for a given depth of heat transfer element. These high heat transfer elements conventionally have open flow channels which provide the high heat transfer but which allow the energy from the soot blowing stream to spread or diverge as it travels into the elements. The divergence of the soot blower stream greatly reduces cleaning efficiency of the heat transfer element closest to the soot blower, and also more remotely positioned heat transfer element layers.

The most significant amounts of fouling typically occur in the cold end layer due at least in part to condensation. The obliquely oriented flow channels of conventional high heat transfer elements often preclude their use in the cold end layer due to the soot blowing energy being significantly dissipated during penetration of such high heat transfer elements. Therefore, in order to provide heat transfer surfaces that allow for effective and efficient cleaning by soot blowing, heat transfer and energy recovery have typically been compromised. In order to decrease soot blowing energy dissipation, closed channel elements are employed. Closed channels elements typically are only open at the ends of the channels. The channels are preferably straight and do not fluidly interconnect. However, generally twice the depth of closed channel heat transfer elements are required to provide the equivalent heat transfer capacity compared to conventional obliquely oriented flow channel, high heat transfer elements.

As an example, in testing done on a conventional closed channel, cold end heat transfer element, soot blower energy was measured to be decreased only 4% by the presence of the heat transfer element. However, the same testing of a high heat transfer element having obliquely oriented and interconnected flow channels having only one half the depth of the cold end heat transfer element, but an equivalent heat transfer capacity, resulted in a reduction of soot blower energy of over 55%.

SUMMARY OF THE INVENTION

Briefly stated, the invention is an improved heat transfer element for the transfer of heat from a flue gas stream to an air stream in a rotary regenerative air preheater. The heat transfer element comprises a first heat transfer plate defining straight, equidistantly laterally spaced apart, mutually parallel notches. The notches preferably extend longitudinally the entire depth of the heat transfer element. Each notch is formed from parallel double ridges extending preferably symmetrically from opposite sides of the first heat transfer plate. Positioned between the straight notches are undulations preferably oriented at an angle to the notches. The first plate is in contact with a second adjacent heat transfer plate.

The second heat transfer plate has straight, equidistantly laterally spaced apart, mutually parallel flat sections. The flat sections also preferably extend longitudinally the depth of the heat transfer element. The flat sections on the second heat transfer plate are in corresponding opposite relationship with the notches on the first heat transfer plate. The ridges of the notches on the first heat transfer plate are in generally line contact with the flat sections on the second heat transfer plate. The second plate further has undulations positioned between and preferably oriented at an angle to the flat sections. Therefore, the notches and flat sections of both the first and second heat transfer plates are mutually parallel. The first and second heat transfer plates together define generally straight channels therebetween.

In one preferred embodiment of the invention, a stack of generally identical heat transfer plates define a heat transfer element. Each heat transfer plate has straight, equidistantly laterally spaced apart, mutually parallel notches. Alternating between and parallel to the notches are straight equidistantly laterally spaced apart, mutually parallel flat sections. The notches and flat sections of the heat transfer plates are mutually parallel. The distance from each notch to the next adjacent notch, and from each flat to the next adjacent flat, is generally equivalent. Furthermore, the distance between each adjacent flat section and notch is preferably equivalent. Between the alternating notches and flat sections are undulations oriented at an angle to the notches and flat sections.

The heat transfer element is constructed as a stack of the generally identical heat transfer plates. The plates are arranged in generally mutually parallel relationship with every other plate offset one half the distance between a pair of notches. Therefore, when arranged in the stack, the notches of an initial heat transfer plate are in surface to surface contact with the flat sections of each adjacent heat transfer plate, and the notches of the adjacent heat transfer plates are in surface to surface contact with the flat sections of the initial heat transfer plate. The initial and adjacent heat transfer plates therefore define channels therebetween. The channels are open at the ends for the passage of a fluid medium such as flue gas and air therethrough, but effectively closed on the longitudinally extending sides to prevent dissipation of soot blower energy.

The heat transfer element of the invention provides high heat transfer while also allowing for efficient and effective soot blowing. The heat transfer surface provides a high heat transfer efficiency by virtue of the turbulence and boundary layer interruptions introduced by the undulations on the heat transfer plates. The heat transfer element further provides a closed element profile such that soot blower energy is not dissipated.

An object of the invention is to provide a heat transfer element having improved heat transfer capacity.

Another object of the invention is to provide a heat transfer element allowing for improved soot blowing.

A still another object of the invention is to provide a heat transfer element that permits soot blower energy to penetrate through the heat transfer surface with sufficient energy to clean heat transfer elements positioned further from the soot blowing equipment.

These and other objects of the invention will be apparent from review of the specification and drawings.

DESCRIPTION OF THE PREFERRED EMBODIMENT

Figure 1:
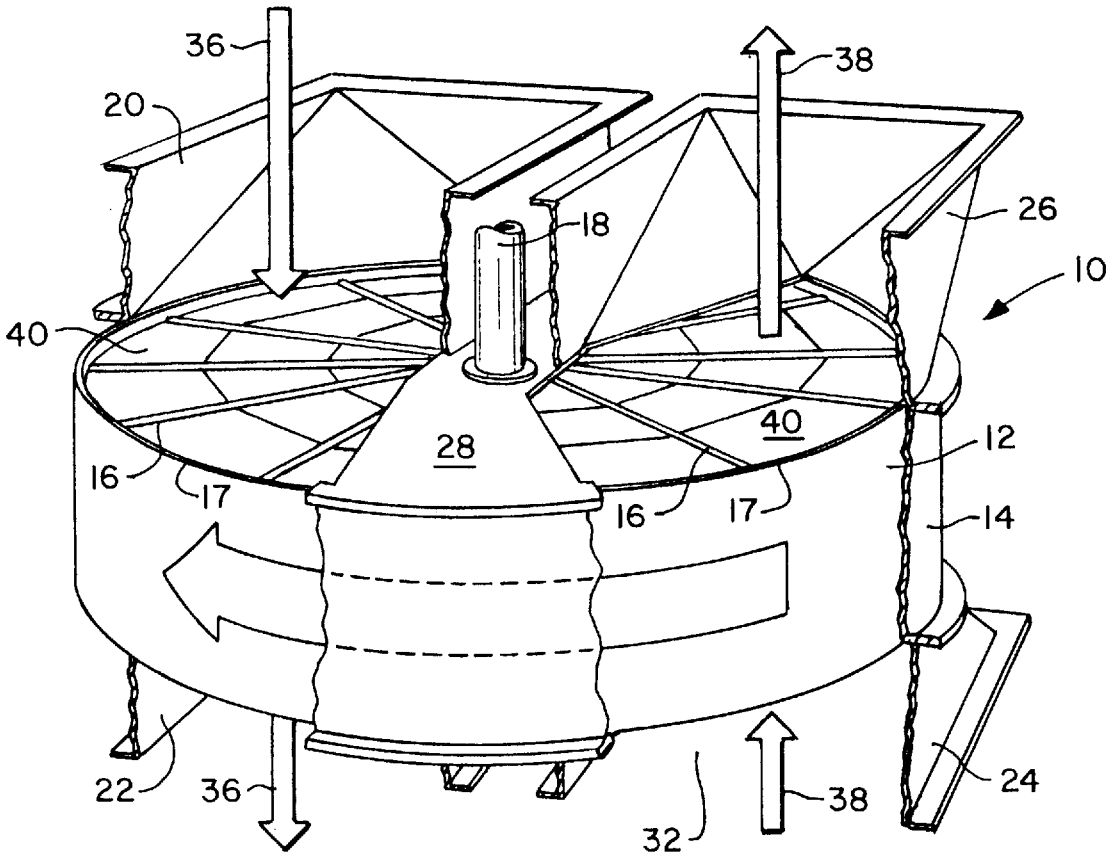
FIG. 1 PRIOR ART
FIG. 1 is a partially broken away perspective view of a rotary regenerative preheater.

With reference to FIG. 1 of the drawings, a conventional rotary regenerative preheater is generally designated by the numerical identifier 10. The air preheater 10 has a rotor 12 rotatably mounted in a housing 14. The rotor 12 is formed of diaphragms or partitions 16 extending radially from a rotor post 18 to the outer periphery of the rotor 12. The partitions 16 define compartments 17 therebetween for containing heat exchange elements 40.

The housing 14 defines a flue gas inlet duct 20 and a flue gas outlet duct 22 for the flow of heated flue gases through the air preheater 10. The housing 14 further defines an air inlet duct 24 and an air outlet duct 26 for the flow of combustion air through the preheater 10. Sector plates 28 extend across the housing 14 adjacent the upper and lower faces of the rotor 12. The sector plates 28 divide the air preheater 10 into an air sector and a flue gas sector. The arrows of FIG. 1 indicate the direction of a flue gas stream 36 and an air stream 38 through the rotor 12. The hot flue gas stream 36 entering through the flue gas inlet duct 20 transfers heat to the heat transfer elements 40 mounted in the compartments 17. The heated heat transfer elements 40 are then rotated to the air sector 32 of the air preheater 10. The stored heat of the heat transfer elements 40 is then transferred to the combustion air stream 38 entering through the air inlet duct 24. The cold flue gas stream 36 exits the preheater 10 through the flue gas outlet duct 22, and the heated air stream 38 exits the preheater 10 through the air outlet duct 26.

Figure 2:
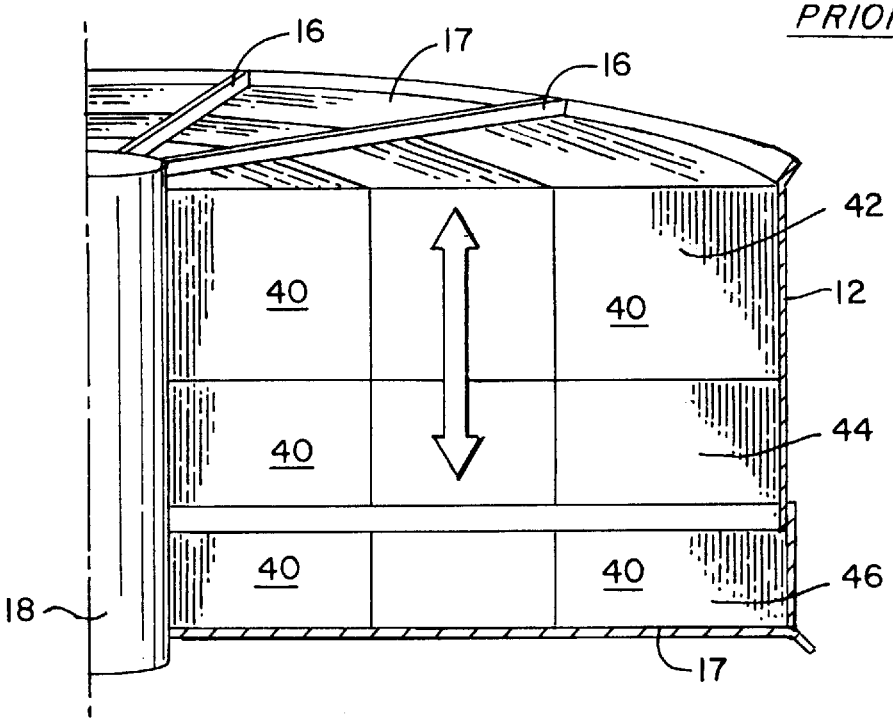
FIG. 2 is a fragmentary, cross sectional view of the rotor of FIG. 1.
Figure 3:
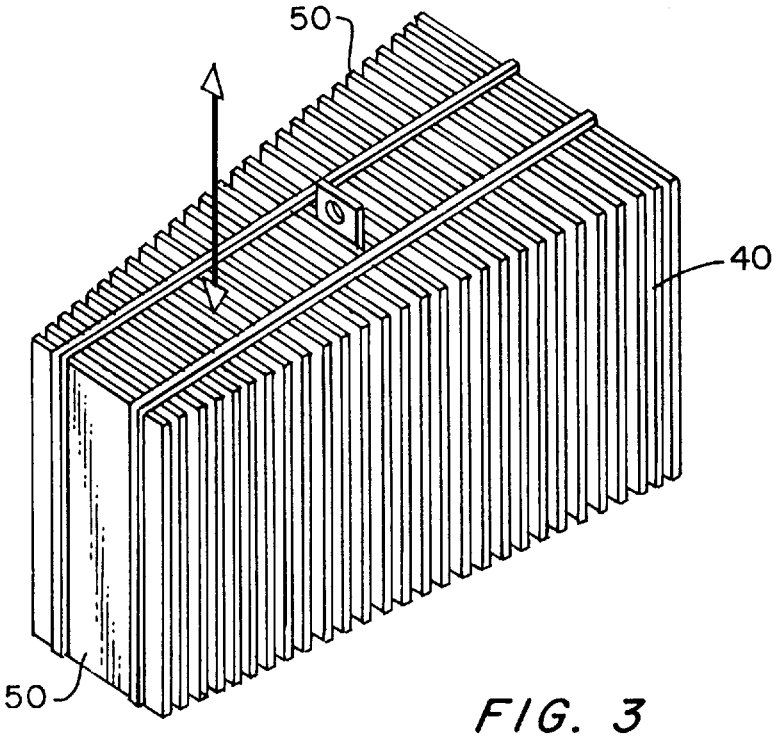
FIG. 3 is a perspective view of a heat transfer element of FIG. 2 in accordance with the invention.

The rotor 12 has generally three layers of heat transfer elements 40. (See FIGS. 2 and 3) A hot end layer 42 is positioned closest to the flue gas inlet duct 20 and the air outlet duct 26. An intermediate layer 44 is positioned next to the hot end layer, and finally a cold end layer 46 is positioned generally next to the flue gas outlet duct 22 and air inlet duct 24.

Conventionally, the most significant fouling of the heat transfer elements 40 occurs in the cold end layer 46. Particulates, scales and deposits condensed out of the cooled flue gas, together generally referred to as soot, most typically collect on the cold end layer 46. Therefore, soot blowing equipment (not shown) for removing soot and other contaminants from the rotor 12 is typically positioned at the cold end of the rotor 12. The cleaning medium of the soot blower, typically compressed air or dry steam, must penetrate through the cold end layer 46 to the intermediate layer 44 and the hot end layer 42 in order to obtain efficient and effective cleaning of the entire rotor 12.

The heat transfer element 40 in accordance with the invention is preferably employed in the cold end layer 46 of the rotor 12. However, in circumstances where it is preferred that a line of sight exist through the entire rotor 12, or for other performance criteria, the heat transfer element 40 can be further employed in the intermediate and hot end layers 44, 42.

Figure 4:
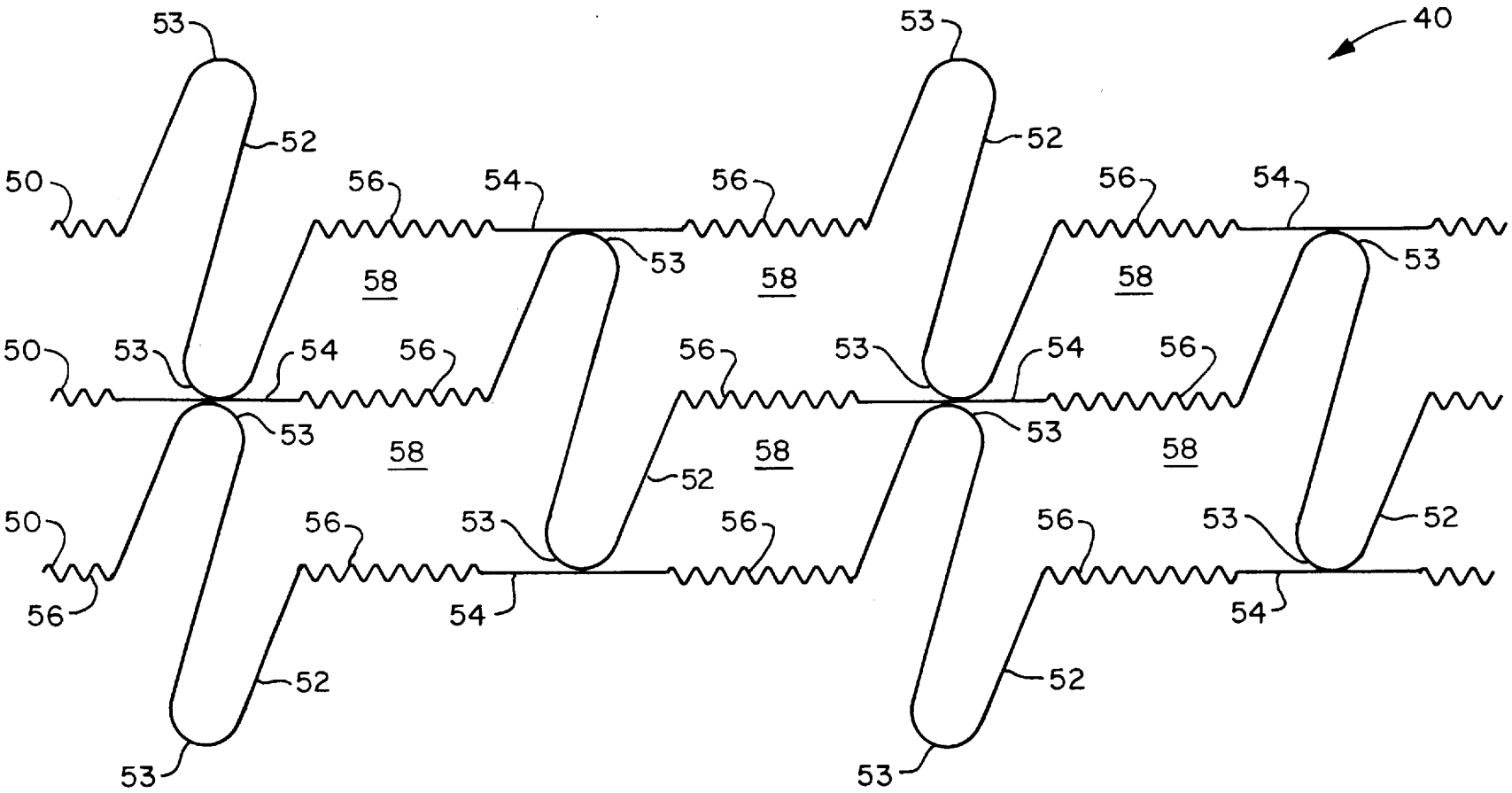
FIG. 4 is a fragmentary end-on-view of the heat transfer element of FIG. 3.
Figure 5:
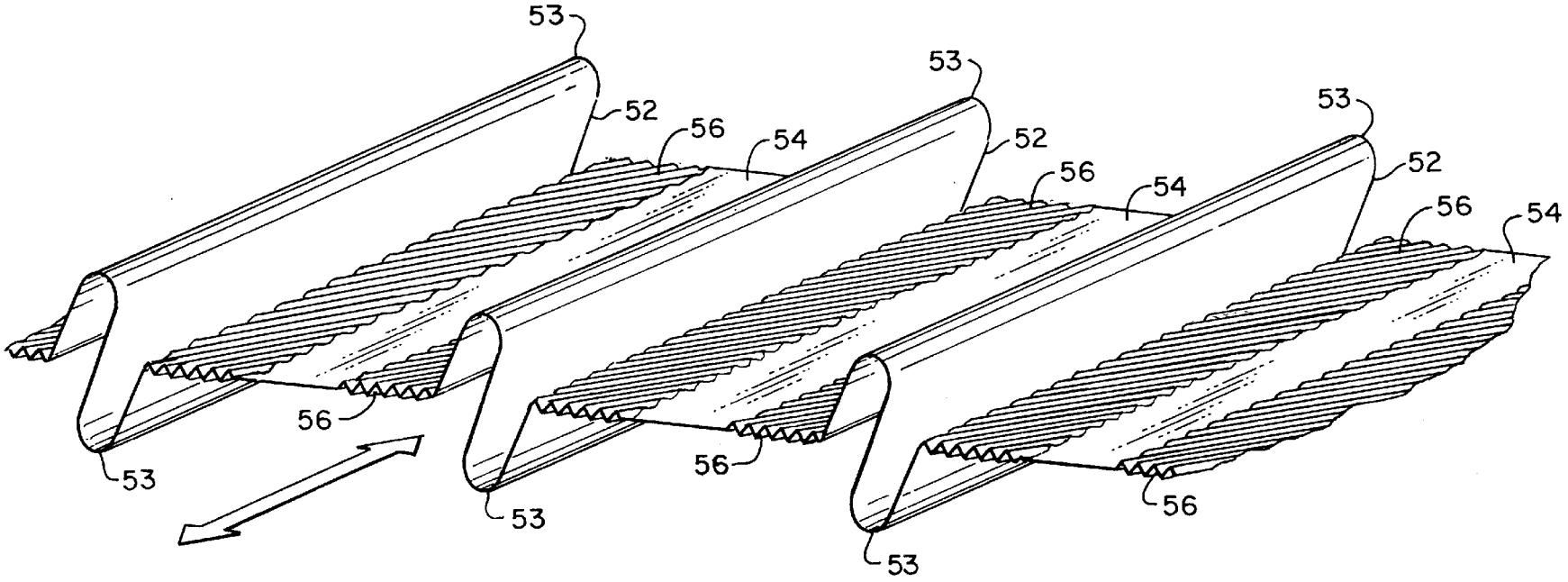
FIG. 5 is a fragmentary perspective view of the heat transfer plate of FIG. 3.

The heat transfer element 40 in accordance with the invention is formed as a stack of heat transfer plates 50. (See FIGS. 3–5) The preferred heat transfer plates 50 are generally the same in profile, having a series of alternating, straight, mutually parallel notches 52 and flat sections 54. The notches 52 and flat sections 54 preferably extend longitudinally the entire depth of the heat transfer element 40. Furthermore, the notches 52 and flat sections 54 are oriented parallel to the main flow direction of the air stream 38 and flue gas stream 36 through the heat transfer element 40. The main flow direction is indicated by arrows in FIGS. 2, 3 and 5. Undulations 56 oriented at an angle to the notches 52 and flat sections 54 extend laterally between each notch 52 and flat section 54. The flat sections 54 are generally in a plane defined by the heat transfer plate 50. The undulations 56 extend transversely from the plane of the heat transfer plate 50 a relatively small distance. Each notch 52 is formed of parallel double ridges 53 extending transversely from the opposite faces of the heat transfer plate 50. The ridges 53 extend a greater transverse distance from the plane of the heat transfer plate than the undulations extend transversely from the plane of the heat transfer plate 50.

In the preferred heat transfer plate 50, the notches 52 have a generally S-shaped cross section. However, the notches 52 can also have a more triangular or Z-shaped cross section, or have other well-known shapes of notches to form oppositely transversely extending multiple ridges.

Each flat section 54 is positioned equidistantly laterally from each adjacent flat section 54 the same lateral distance the notches 52 are positioned laterally from each adjacent notch 52. Therefore, the ridges 53 of each notch 52 can be positioned on one of the flat sections 54 of an adjacent heat transfer plate 50. Therefore, by production of heat transfer plates 50 of a single profile, heat transfer elements 40 can be readily constructed.

The ridges 53 of the notches 52 of one heat transfer plate 50 will be generally in line contact with the opposite flat section 54 of an adjacent heat transfer plate 50. (See FIG. 4) The flat sections 54 have a width sufficient to ensure that the notches contact the flats even with small manufacturing variations. In addition, the flat sections 54 are flat relative to the undulations 56 and notches 52. Therefore, the flat sections 54 can be slightly curved in the lateral direction and still generally maintain line contact with the notch 52 of an alternately positioned heat transfer plate 50. Together the pair of heat transfer plates 50 define channels 58 of generally constant cross section therebetween. The heat transfer plates 50 preferably extend longitudinally the entire depth of the heat transfer element 40. Furthermore, the channels 58 defined by adjacent contacting heat transfer plates 50 are effectively closed on the longitudinally extending sides, allowing for the efficient penetration of soot blowing cleaning medium into and through the heat transfer element 40. The cleaning medium of the soot blower enters the channels 58 through the open end of the channels 58 to efficiently clean the heat transfer elements 40 and the heat transfer elements of more remote subsequent layers in the rotor 12.

The flat sections 54 are preferably equidistantly positioned laterally from each adjacent notch 52. Therefore, the distance between a particular flat section 54 and an adjacent notch 52 is approximately half the distance between one flat section 54 and an adjacent flat section 54. The preferably equivalent cross sectional areas of the channels 58 are for efficient heat transfer between the fluid medium and the heat transfer element 40.

The undulations 56 between the notches and flat sections 54 generate turbulence in the fluid medium flowing through the heat transfer element 40. The turbulence disrupts the thermal boundary layer between the surface of the heat transfer plate and the fluid medium of air or flue gas. Therefore the undulations improve heat transfer between the heat transfer plate 50 and a fluid medium. In one heat transfer element constructed in accordance with the invention, the undulations are oriented 60° from the longitudinally extending notches 52 and flat sections 54. The straight channels 58 defined by the adjacent heat transfer plates 50, do not produce a significant pressure drop across the heat transfer element 40 for a given heat transfer capacity.

The heat transfer plate 50 of the invention is preferably formed from a single sheet of any well known material for the production of heat transfer elements. The sheet is first rolled to define the angled undulations 56. Then at prescribed intervals, the undulations are rolled out of the sheet to form either a notch 52 or a flat section 54. The flat sections 54 preferably occur mid-way between any two notches 52, and the notches 52 are equidistantly positioned laterally on the sheet. For production of the heat transfer element 40, the heat transfer plates 50 are trim cut to allow the heat transfer plates 50 to be shifted sideways to form the stack. The sideways shifting of every other heat transfer plate 50 positions the flat sections 52 of one heat transfer plate 50 in contact with the ridges 53 of the notches 52 on the adjacent heat transfer plate 50.

Figure 6:
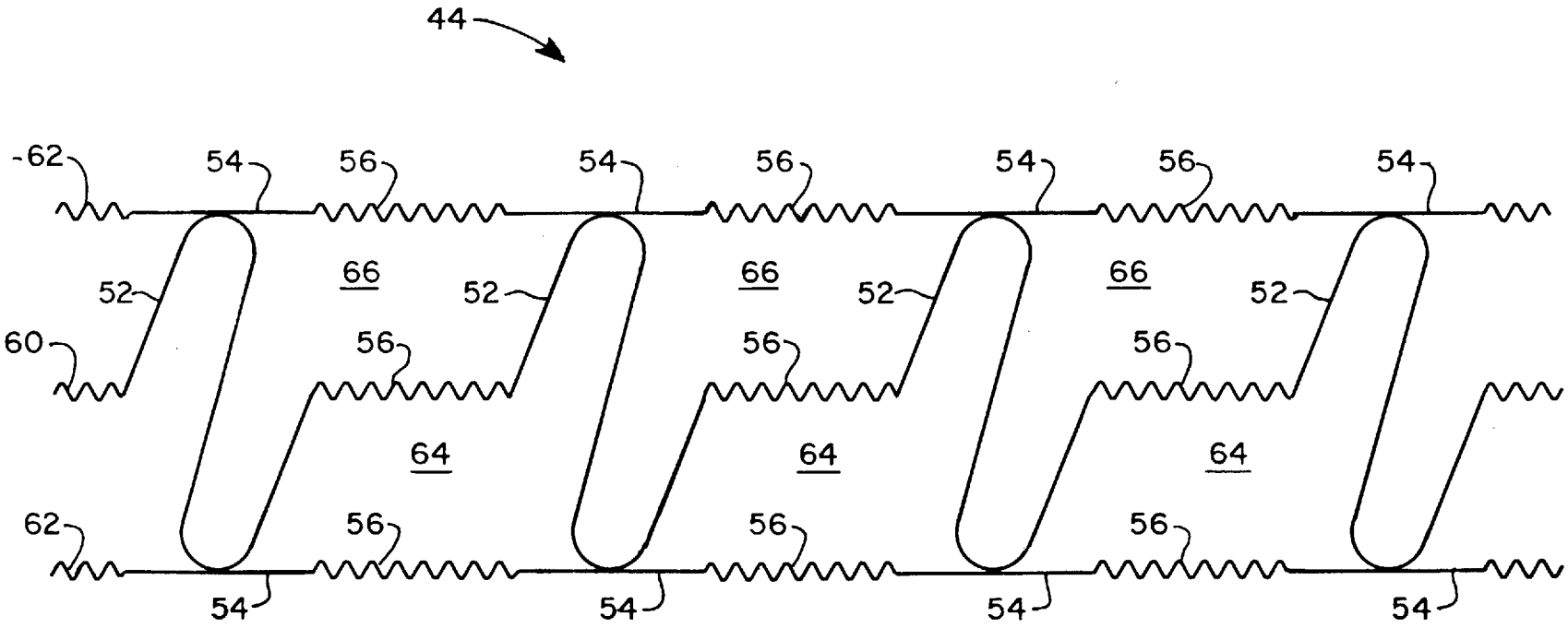
FIG. 6 is a fragmentary end-on-view of an alternate embodiment of a heat transfer element in accordance with the invention.

With reference to FIG. 6, in an alternate embodiment of the invention, a heat transfer element 44 is constructed of heat exchange plates wherein notches 52 and flat sections 54 are positioned on alternating heat transfer plates. A first heat transfer plate 60 defines straight, equidistantly laterally spaced apart, longitudinally extending notches 52. The notches 52 are generally mutually parallel. Undulations 56 extend laterally between the notches 52 and are oriented at an angle to the notches 52. Second heat transfer plates 62 defining straight, equidistantly laterally spaced apart, longitudinally extending flat sections 52, are positioned on either side of the first heat transfer plate 60. The flat sections 54 of each second heat transfer plate 62 are oriented longitudinally mutually parallel to each other. Undulations 56 extend laterally at an angle between the flat sections. The distance between adjacent flat sections 54 on the second heat transfer plates 62 is generally equal to the distance between adjacent notches 52 on the first heat transfer plate 60. The notches 52 and flat sections 54 are generally parallel to the main flow direction of the fluid mediums through the preheater 10. A heat transfer element 44 is constructed as a stack of alternating first and second heat transfer plates 60, 62. The ridges 53 of the notches 52 on the first plate 60 are preferably in surface to surface line contact with the flat sections 54 of the adjacent second heat transfer plates 62.

The arrangement of the heat transfer plates 60, 62 to form the heat transfer element 44 defines channels 64, 66 of generally constant cross section therebetween. The channels 64, 66 are generally longitudinally straight, providing a line of sight view through the heat transfer element 44 for the efficient detection of hot spots and element fires within the rotor 12. Furthermore, the channels 64, 66 are essentially closed on the longitudinally oriented sides to permit efficient soot blowing of the heat transfer element 44 and subsequent heat transfer elements located on the rotor 12.

While preferred embodiments of the present invention have been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

I claim:

1. A heat transfer element for a rotary regenerative preheater comprising:

a first heat transfer plate defining a plurality of generally equidistantly laterally spaced apart, parallel straight notches, each of said notches comprising adjacent double ridges extending transversely from opposite sides of said first heat transfer plate, and undulations extending between said notches;

a second heat transfer plate adjacent said first heat transfer plate, and defining a plurality of generally equidistantly laterally spaced apart, parallel straight flat sections and undulations extending between said flat sections, said flat sections being spaced apart a distance generally equal to the lateral spacing of said notches, said notches of said first heat transfer plate being in contact with said flat sections of said second heat transfer plate to thereby define channels therebetween.

2. The heat transfer element of claim 1 wherein said double ridges of said notches define an S-shaped cross section.

3. The heat transfer element of claim 1 wherein said first heat transfer plate defines flat sections alternating between and parallel to said notches, and said second heat transfer plate defines notches alternating between and parallel to said flat sections, said notches of said second heat transfer plate being in contact with said flat sections of said first heat transfer plate.

4. The heat transfer element of claim 3 wherein said notches and said flat sections of both said first and second heat transfer plates are equidistantly laterally spaced apart.

5. The heat transfer element of claim 1 wherein said undulations are at an angle to said flat sections and said notches.

6. A heat transfer plate comprising:

a plate defining laterally spaced apart mutually parallel straight notches and straight flat sections, said notches comprised of adjacent parallel double ridges extending transversely from opposite sides of said plate, and undulations between said flat sections and said notches, said notches being equidistantly laterally positioned from each adjacent notch and said flat sections being equidistantly laterally positioned from each adjacent flat section, the distance between adjacent notches being generally equal to the distance between adjacent flat sections.

7. The heat transfer plate of claim 5 wherein said flat sections are spaced midway between adjacent notches.

8. The heat transfer plate of claim 5 wherein said notches define an S-shaped cross section.

9. The heat transfer plate of claim 5 wherein said undulations are at an angle to said flat sections and said notches.

* * * * *